United States Patent [19]

Guraydin

[11] 4,053,857

[45] Oct. 11, 1977

[54] RESETTABLE ELECTRO-MECHANICAL VACUUM FUSE

[75] Inventor: Orhan A. Guraydin, San Jose, Calif.

[73] Assignee: International Telephone and Telegraph Corporation, New York, N.Y.

[21] Appl. No.: 693,287

[22] Filed: June 7, 1976

[51] Int. Cl.[2] ..... H01H 9/30

[52] U.S. Cl. ..... 335/147; 335/195; 200/147 R; 200/329; 200/144 B

[58] Field of Search ..... 200/153 D, 153 E, 241, 200/245, 329, 145, 144, 147 R, 147 B, 330, 337, 338, 61.08, 61.8; 335/170, 173, 201, 16, 195, 147

[56] References Cited

U.S. PATENT DOCUMENTS 3,996,438 12/1976 Kurtz ..... 200/144 B

*Primary Examiner*—Robert K. Schaefer
*Assistant Examiner*—L. Pojunas
*Attorney, Agent, or Firm*—William T. O'Neil

[57] ABSTRACT

A resettable high-voltage fusing device including a vacuum interrupter and an arrangement of magnetically displaceable rod members which are displaced by the magnetic forces resulting from overload currents flowing through them. For currents below the "blow" rating, a spring arrangement keeps the rods in place by applying axially opposing forces at the ends thereof, and the vacuum interrupter is kept closed. After rod displacement caused by overload current the vacuum interrupter opens in response to one of the springs released by displacement of the rods.

10 Claims, 5 Drawing Figures

RESETTABLE ELECTRO-MECHANICAL VACUUM FUSE

BACKGROUND OF THE INVENTION

1. Field of the Invention

The invention relates to electric circuit fusing devices, especially for high voltage, high current applications.

2. Description of the Prior Art

The term "fuse" implies a protective device for interrupting the flow of an electric current when, due to overload or circuit faults, a current flow in a protected circuit exceeds a certain design value.

Four different types of high-power, high-voltage circuit fuses are presently common in industry and power utility uses. These may be categorized as follows:

1. Oil expulsion fuses
2. Air expulsion fuses
3. Energy limiter fuses
4. Vacuum fuses Oil expulsion fuses involve placement of the expendable fuse element in a tank of oil. While these have certain advantages in respect to containment of the by-products of fuse operation and containment of accompanying sounds, they also have major disadvantages. Among these disadvantages is the very limited interrupting capability. For fault currents above the level of approximately 3000 amperes, this type of fuse can fail to clear, continuing to arc under oil. The resulting sustained fault current can cause circuit damage, and arcing within the oil container with consequent buildup pressure therein.

In overhead systems such as primary and secondary overhead distribution systems, the air expulsion fuse is often employed. These devices produce relatively high sound levels and expel substantial amounts of by-product during operation. It is necessary that the "blow" of such a device produce a substantial gap to prevent sustained arcing which would prevent the fuse from clearing. Such a device does not lend itself to compact mounting and the operational sound levels are also undesirable in many instances.

Energy limiter fuses have certain characteristics which make them very attractive for the so-called "dead-front" switch application. There are difficulties however, in achieving flexibility and loadability. For example, there are only a limited number of full range clearing fuse sizes available at the present time. Also, the low amperage ratings tend to limit full utilization of the 200 ampere capability of the taps.

The vacuum fuse is a relatively new device and at present it is constructed similar to a vacuum interrupter with two stationary contacts joined by a copper connecting link all enclosed in a vacuum bottle. There is no means provided for mechanically separating the stationary contacts as would be the case in a vacuum interrupter, the operation of the device depending upon the melting of the copper link. Initially at least, an arc is established when the link melts, but once the energy available for the system is less than the energy need to sustain the lengthening arc, the vacuum fuse will effectively clear. The high dielectric strength and dielectric recovery rate in the vacuum fuse prevents restrike or reignition. Typical current ratings are on the order of 150 amperes, 200 amperes, 250 amperes and possibly as much as 300 amperes. Interrupt capability is on the order of 12 KA symmetrical. Typical voltage ratings are 8.3 KV and 15 KV. Vacuum fuses have certain advantages over the other prior art fuses aforementioned, and have very good coordination with transformer explosion fuses.

In all of the foregoing prior art fusing devices, the device is either totally expendable or requires reprocessing to be readied for additional service.

The manner in which the present invention offers great improvement over the prior art devices will be understood as this description proceeds.

SUMMARY OF THE INVENTION

The present invention might be alternatively referred to as a fuse/interrupter hybrid device, since it uses a vacuum interrupter of known type as a fuse element and an unique electro-mechanical triggering mechanism with integral current sensing capability. The resettable fuse device in accordance with the invention has all the advantages of a vacuum enclosure, including high current and voltage capability, and in addition, provides a non-expendable (resettable) arrangement which is inherently simple and of low cost.

A known type vacuum interrupter assembly is employed, that device having a shaft which is mechanically movable in cooperation with a bellows to effect making and breaking of an actual mechanical contact within the evacuated envelope thereof. A spring arrangement tends to mechanically bias a pair of externally arranged conductive plate members toward each other, a pair of rods being held therebetween, so that a predetermined spacing of the plates is established. The conductive path passes through a first of these plates, through the conductive rods, through a second of the plates and from there into the movable terminal shaft of the vacuum interrupter. Grooves in at least one of the plates permits their dislocation in response to magnetic forces set up as a result of the currents flowing therethrough, when those currents exceed a predetermined value. The displacement or dislocation of the rods may take any of several forms, to be described hereinafter, but in any event, this dislocation of the conductive rods allows the spring means to move the second plate (connected to the interrupter shaft) in a manner causing the contacts of the interrupter to separate and the circuit to be opened. Repositioning of the plates and reinsertion of the conductive rods is relatively easily accomplished, the fusing device being immediately ready for further service thereafter.

The details of a preferred embodiment for implementing the invention are described hereinafter.

DESCRIPTION OF THE PREFERRED EMBODIMENT

Figure 1:
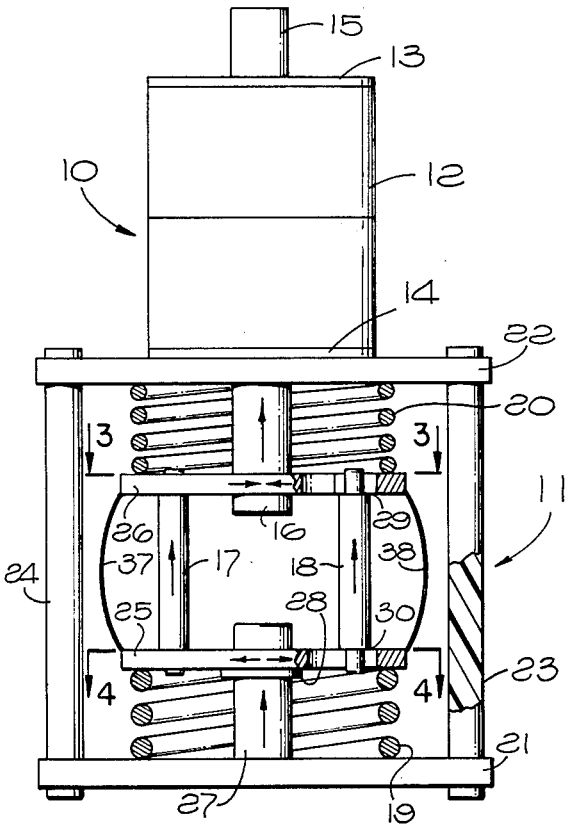
FIG. 1 is a partially sectioned side view of a device in accordance with the invention in the "ready to operate" condition.

Referring now to FIG. 1, a typical assembly in accordance with the invention is depicted, comprising a vacuum interrupter 10 mounted on the current sensing and actuating assembly 11. The vacuum interrupter 10 is preferably, although not necessarily, one of the general type described in U.S. Pat. No. 3,368,023 or In U.S. Pat. No. 3,555,222. U.S. Pat. No. 3,627,936 although directed to contact material problems, also shows the type of enclosure suitable for interrupter 10. These devices include a pair of axially opposed internal contact members each mounted on a terminal post. A hollow ceramic insulating body 12 with appropriate endplates 13 and 14 (usually metal) generally houses the interrupter contacts in a hermetically sealed enclosure. The endplates 13 and 14 are usually hermetically brazed to the ceramic body 12 and a fixed terminal post 15 is hermetically brazed through endplate 13. The other contact terminal post 16 is movable axially, the integrity of the evacuated interior of the interrupter being preserved by means of a sealed-in metallic bellows which flexes in response to axial movement of the contact terminal post (shaft) 16.

The magnetically displaceable conductive rods 17 and 18 are held in place in grooves by the spring pressure of the opposing springs 19 and 20. Fixed support plates 21 and 22 are joined by at least two, and preferably three or four, insulating posts, typically 23 and 24. Thus the fixed support plates 21 and 22, which are conductive of themselves, are insulated from each other. The springs 19 and 20 operate between fixed plate 21 and movable plate 25; and between fixed plate 22 and movable plate 26, respectively. A conductive guidepost 27 is mechanically and electrically affixed to the bottom support plate 21 and acts as a guideshaft for the movable plate 25. The element 27 is shown with an annular collar 28 affixed thereto, to act as a stop for movable plate 25. The contact terminal post 16 of interrupter 10 is mechanically and electrically fixed to the upper movable plate 26, and therefore its position in the vertical dimension (as seen on FIGS. 1 and 2) determines whether the interrupter contacts within enclosure 12 are open or closed. It is to be assumed that these contacts are closed in the condition depicted in FIG. 1 and open in the condition depicted in FIG. 2.

The two terminals of the completed device of FIG. 1 are to be understood to be 15 and the bottom support plate 21. From 21, arrows show the current directions through 27, dividing in 28 to pass approximately half of the current in each of the conductive displaceable rods 17 and 18. The currents subsequently follow the arrows through 26 and 16.

Figure 3:
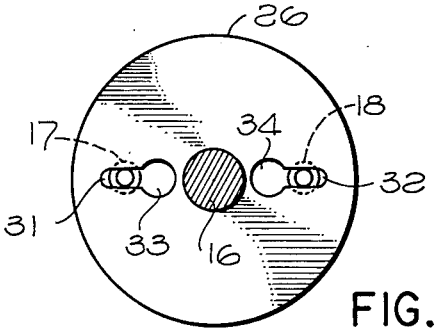
FIG. 3 is a planar view of the top one of the conductive rods supporting plates as shown in FIGS. 1 and 2.

Referring now to FIG. 3, a detail of plate 26 of FIG. 1 is shown in a plane orthogonal with respect to the view presented in FIG. 1. The rods 17 and 18 are seen to have a diminished diameter at their extremities, thereby forming shoulders, typically at 29 and 30. The plates 25 and 26 are partially sectioned to illustrate this more clearly. A pair of diametrically opposed "key-hole shaped" slots are shown, each having a small width portion (31 and 32) and each also having an enlarged portion (33 and 34). As depicted in FIG. 1, the "non-blown" locations of the conductive rods 17 and 18 would be approximately as also shown in FIG. 3. Thus, the shoulders on the conductive rods, such as typically extant at 29 and 30 on FIG. 1, but also extant on the ends of 17, bear against the plates 25 and 26, since the full diameter of the rods 17 and 18 is greater than the width of slot portions 31 and 32.

Figure 4:
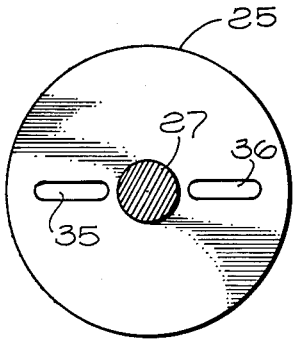
FIG. 4 is a planar view of the bottom one of the two conductive rods supporting plates of FIGS. 1 and 2.

FIG. 4 is representative of the lower plate 25, and contains two opposing slots 35 and 36 which are respectively of the same width as the small width portions of the slots in FIG. 3. These slots are, of course, generally aligned such that when the rods 17 and 18 are in place, these rods are generally parallel to the axial centerline of the device.

As hereinabove indicated, the current passing through the device divides approximately equally between rods 17 and 18. From the general rules describing the magnetic force fields generated as a result of currents flowing through conductors, it can be shown that the currents passing through 17 and 18 cause an electromagnetic force tending to draw them together. When these currents exceed a predetermined design value by a substantial amount, this force tending to draw the rods together is sufficient to overcome lateral static force represented by the friction between rods 17 and 18 and the plates 25 and 26 for given spring parameters.

Figure 2:
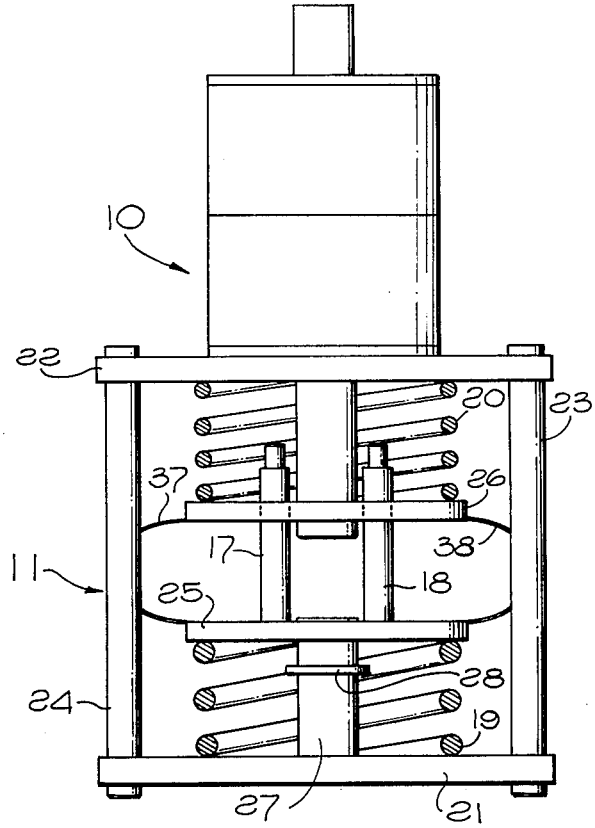
FIG. 2 depicts the device of FIG. 1 in the "blown" condition.

One the "blow" current value is reached or exceeded, 17 and 18 migrate toward each other with the result that the upper ends (as depicted in FIGS. 1 and 2) of the conductive rods 17 and 18 slide through the clearance size slot portions 33 and 34 in the plate 26 producing the condition generally depicted in FIG. 2. That is, plate 26 has moved downward under the urging of spring 20 which might be characterized as the interrupter opening spring. Plate 25 will have moved upward as well under the urging of spring 19.

It should be noted that between FIGS. 1 and 2, the mechanical displacements shown may be somewhat exaggerated. This is because the amount of travel of the plate 26 and consequently of the terminal post 16 of the interrupter 10 required in order to effect circuit break, is relatively small. That fact is one of the inherent advantages of vacuum breakers. It was considered desirable to exaggerate the mechanical relationships slightly however, for illustration.

A pair of by-pass strips 37 and 38 are illustrated in FIGS. 1 and 2. These conductive strips are highly flexible elements which are small in cross-section and may be of a material having a higher specific resistivity as compared to rod 17 and 18. Accordingly, the amount of current diverted from the main current paths through 17 and 18 by these strips 37 and 38 is relatively small in FIG. 1. The purpose of the by-pass strips 37 and 38 is to provide an instantaneous current path at the instant rods 17 and 18 being to move under the magnetic forces generated by overload currents and through the time that they have "fallen through" slot portions 33 and 34. This prevents arcing between the rods 17 and 18 and plate member 25 and especially plate member 26. Once the vacuum interrupter is open however, the by-pass strips which now have assumed a bowed-out shape as in FIG. 2, no longer carry current.

At least one similar flexible by-pass strips may also be connected between plate 25 and post 27 to avoid arcing between 25 and 27 as the plate 25 slides upward, and to reduce current flow through spring 19.

Figure 5:
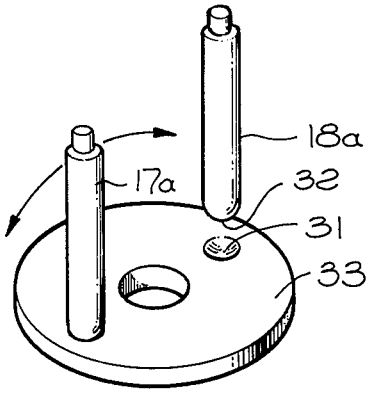
FIG. 5 is a pictorial view of an alternate bottom plate with alternate conductive rod configuration.

FIG. 5 depicts one alternative shape for the conductive rod 17 and 18, the corresponding rods being identified in FIG. 5 as 17*a* and 18*a.* Each of these alternative rods has a generally convex end 32 which fits into a concave impression 31 in the lower plate 25, for example.

If the device of FIG. 1 were constructed in this alternative way, the blown position illustrated in FIG. 2 would show the rods 17 and 18 tilted toward each other at their top portions as they projected through the clearance portions 33 and 34.

Of course, the plate slot configuration of FIG. 3 might also be applied to 25 in which case the conductive rods 17 and 18 could be permitted to drop completely through plate 25 to rest against the lower support plate 21. The arrangement of FIG. 5 could likewise be applied, the plate 33 taking the place of 26 in FIGS. 1 and 2 and the plate 25 being constructed in accordance with FIG. 3.

Still further, the option is available for constructing the rods 17 and 18 hinged at the outer diameters substantially at their lengthwise centers to allow inward "collapse" in response to the magnetic forces of an overload current. These forces tend to be maximum at the rod centers. In that variation, the rod ends might both be rounded (see 32 in FIG. 5) at both ends, and plates (planar members) 25 and 26 would both have concave impressions (see 31 in FIG. 5) in lieu of slots to retain the rods in normal operation. Such a variation of the structure would be substantially independent of sliding friction considerations, the static lateral forces being produced by a mechanical moment about the hinge as a fulcrum. The rods then may be said to have "knees".

From an understanding of the principles of the present invention obtained from the foregoing descriptions, various other modifications of the detailed mechanical and electrical features of a device utilizing the principles of the present invention will suggest themselves to those skilled in this art. For one example, a workable alternative structure could be made if spring 19 were eliminated and plate 25 were permanently affixed to post 27. Accordingly, it is not intended that the drawings or this description would be considered as limiting the scope of the invention, these being typical and illustrative only.

What is claimed is:

1. An electro-mechanical device for interrupting at least one electric circuit whenever the current carried by said circuit substantially exceeds a predetermined value, comprising:

a vacuum interrupter having at least one pair of contacts and a control shaft, said contacts providing circuit continuity in response to a first position of said control shaft, and said contacts separating to interrupt said circuit in response to a second position of said control shaft;

first means external to said vacuum interrupter and including at least a pair of generally parallel conductive rods arranged in said circuit to divide most of the current in said circuit between the rods of said pair;

second means including resilient mounting means for holding said rods in place by application of longitudinal pressure thereon, said rods being displaceable, at least at one displacement point along the length thereof, by application of a laterally acting force sufficient to overcome the laterally acting static forces extant at said displacement point;

and third means associated with said resilient mounting means and connected to said interrupter control shaft to cause said shaft to assume said second position in response to a magnitude of current in said rods sufficient to produce corresponding magnetic forces overcoming said laterally acting static forces and therefore to produce lateral displacement of said rods.

2. Apparatus according to claim 1 in which said second means comprises first and second generally planar and mutually parallel members, and said resilient mounting comprises at least one of first and second resilient members corresponding to said first and second planar members, respectively, said resilient members being arranged to mechanically bias said planar members toward each other, said rods being placed so as to hold said planar members in a first spaced relationship in which said interrupter control shaft is in said first position.

3. Apparatus according to claim 2 in which said third means includes a connection between said interrupter control shaft and said first planar members, said first resilient member being arranged to exert a force tending to cause said control shaft to assume said second position when said rods are displaced.

4. Apparatus according to claim 3 in which rods are defined as being arranged on opposite radial locations with respect to said shaft, said rods carrying said divided circuit current in the same direction, said magnetic forces thereby being such as to tend to force said rods radially inward to effect said rod diplacement when said circuit current substantially exceeds a predetermined magnitude.

5. Apparatus according to claim 4 in which at least one of said planar members includes a pair of radially opposite slots, said slots being generally radially elongated, and in which end portions of predetermined length on said rods associated with said one of said planar members are of reduced diameter thereby forming shoulders thereon, said elongated slots having widths greater than said reduced rod diameter but less than the unreduced diameter of said rod, said shoulder on each of said rods contacting said one planar member outside the perimeter of the corresponding one of said slots while said reduced diameter portion of each of said rods fits with radial sliding freedom within the corresponding one of said slots to provide said rod displacement radially inwardly at least at said one planar member.

6. Apparatus according to claim 5 in which said slots in said one planar member are of enlarged width at their radially inward ends, said enlarged width exceeding said rod unreduced diameter, said rods thereby extending through said enlarged width when said displacement occurs, said resilient member corresponding to said one planar member then operating to move said interrupter control shaft to said second position.

7. Apparatus according to claim 6 in which said rods are formed with said shoulders on both ends and said first and second planar members both include said slots, said inward displacement of said rods occurring at both ends of said rods.

8. Apparatus according to claim 6 in which said slots are in said first planar member and said second planar member includes a generally concave socket, said rods each having a convex end shaft nested in said sockets, whereby said lateral displacement of said rods occurs substantially only at said first planar member.

9. Apparatus according to claim 2 including at least one flexible conductive by-pass strip joining said planar members to prevent arcing between said planar members and said rods during the rod displacement action before said vacuum interrupter contacts are open, said by-pass strip providing an electrical resistance sufficient to prevent appreciable shunting of the current path provided by said rods.

10. Apparatus according to claim 2 in which said first planar member is defined as being mechanically and electrically connected to said interrupter control shaft and is generally perpendicular in its plane to said interrupter shaft, said first resilient means is a spring arranged to mechanically bias said first planar member away from said interrupter, corresponding to said second interrupter shaft position, said second planar member is slideably mounted and said second resilient means is a spring arranged to mechanically bias said second planar member toward said first planar member, said lateral displacement of said rods effecting movement of said first planar member to open the contacts of said vacuum interrupter.

* * * * *